United States Patent [19]

Zimmermann

[11] 3,936,199

[45] Feb. 3, 1976

[54] METHOD OF AND APPARATUS FOR THE CLEANING OF TEXTILES

[75] Inventor: Erich Zimmermann, Friedrichshafen, Germany

[73] Assignee: Leifheit International Günter Leifheit KG, Nassau, Lahr, Germany

[22] Filed: Mar. 22, 1974

[21] Appl. No.: 453,833

Related U.S. Application Data

[63] Continuation-in-part of Ser. No. 318,615, Dec. 26, 1972, abandoned.

[30] Foreign Application Priority Data

Dec. 28, 1971 Germany ..... 2165008

[52] U.S. Cl. ..... 401/40; 401/47; 401/284; 261/DIG. 26; 15/50 C

[51] Int. Cl.[2] ..... A46B 11/00

[58] Field of Search ..... 401/40–43, 401/47, 282, 284; 169/78–80; 252/359 E; 15/50, 98, 320; 261/DIG. 26

[56] References Cited

UNITED STATES PATENTS

| | | | |
|---|---|---|---|
| 1,214,661 | 2/1917 | Erwin | 169/80 |
| 1,361,997 | 12/1920 | Holmes | 169/79 |
| 1,748,992 | 3/1930 | Pirsch | 169/78 |
| 3,114,927 | 12/1963 | Ballantyne | 401/47 |
| 3,120,676 | 2/1964 | Ballantyne | 401/47 |
| 3,428,985 | 2/1969 | Boyd | 401/47 X |

*Primary Examiner*—Lawrence Charles
*Attorney, Agent, or Firm*—Michael J. Striker

[57] ABSTRACT

A cleaner for carpets, rugs and the like has a roller or brush or the like by means of which cleaning foam is to be applied to the particular textile. It is further provided with two or more chambers, each adapted to contain a chemical component. The chemical components in the several chambers are of the type which, upon contact with one another, will spontaneously react and produce foam for cleaning purposes. An arrangement is provided for permitting the controlled contacting of these components with one another so as to produce the requisite foam which is supplied to the roller or brush.

12 Claims, 4 Drawing Figures

METHOD OF AND APPARATUS FOR THE CLEANING OF TEXTILES

CROSS REFERENCE TO RELATED APPLICATION

This is a continuation-in-part of my copending application Ser. No. 318,615, filed on Dec. 26, 1972, now abandoned.

BACKGROUND OF THE INVENTION

The present invention relates to the production of cleaning foam, and more particularly to the chemical production of such foam for cleaning of textiles, such as rugs, carpets and the like.

It is already known in the prior art, for instance in cleaning apparatus used for carpets or upholstery, to produce foam either mechanically or with the aid of compressed gas. The equipment needed for either of these two approaches to the production of foam is relatively complicated and, therefore, quite expensive. In carpet cleaning devices it is, for instance, known to provide the device with a pressure container which accommodates a gas under pressure and a cleaning liquid or liquids. The container is provided with a valve-controlled opening that is configurated as a mixing nozzle through which the liquid and the compressed gas exit, whereby the liquid becomes converted into foam. The stream of liquid aspirates ambient air as it is forced out of the nozzle and becomes admixed with this air to turn into foam. Evidently, this is a relatively complicated construction, as has already been pointed out above.

SUMMARY OF THE INVENTION

Accordingly, it is an object of the present invention to overcome the disadvantages of the prior art.

More particularly, the invention has as one of its objects to provide an apparatus which is capable of producing foam for cleaning purposes in a simple manner, and which is considerably less complicated to construct and to produce than the equipment known from the prior art.

Another object of the invention is to provide such an apparatus which permits the user to produce foam in a very simple manner in such quantities as are required for a particular application and at a particular time.

Another object of the invention is to provide such an apparatus which produces foam that can be readily removed from the surface that has been cleaned with the foam.

In keeping with the above objects, and with others which will become apparent hereafter, one feature of the invention resides in an apparatus for producing foam for cleaning of textiles, such as rugs and carpets, which apparatus comprises applying means for applying foam to a surface to be cleaned, and wall means defining two chambers, each of which is adapted to accommodate one of two chemical components which react upon contact with one another and spontaneously produce foam for cleaning purposes. Passage means connects the chambers with one another and with the applying means, and control means permits contacting of the components with one another via the passage means, to result in spontaneous production of foam which is supplied to the applying means.

According to the invention, it must be assured that neither of the components which are to be admixed to produce the foam can be allowed to contact the textile to be cleaned, as this might cause damage to the textile. This is particularly true if one of the components is an acid. Moreover, unless the production of the foam is of such a nature that the foam will be dry, the foam is not well suited for cleaning purposes as wet foam does not offer itself for proper cleaning of textiles.

The components which are admixed to produce the foam may be carbonate or bicarbonate, for instance sodium bicarbonate and an acid, for instance phosphoric acid. At least one of the components should advantageously be dissolved in water and at least one of the components should advantageously be admixed with a wetting agent.

Foaming tenside (WAS) may be admixed with one or both components and e.g. the reaction $Na\ H\ Co_3 + \lambda\ COOH = CH_3COONa + H_2O + CO_2$ will occur, which will result in the spontaneous formation of foam that can be readily used for carpets, upholstery, automobiles or the like. Moreover, such a foam can also be used as a heat exchanger to carry away heat from a location which is to be cooled.

One of the components may also be in form of water-dissolved sodium bicarbonate, ammonium bicarbonate, or potassium bicarbonate, and it may have admixed with it a wetting agent, such as disodium laurate ethanolamidosulfosuccinate. The other component may be phosphoric acid and may have admixed with it one or more additional wetting agents, for instance sodium lauryl sulfate.

The various aforementioned components can, for instance, be mixed in one of the ways which are described hereafter, in which case simultaneously the following reactions will take place:

Mixing of sodium bicarbonate ($NaHCO_3$) + phosphoric acid ($H_3PO_4$) results in the production of monosodiumphosphate ($NaH_2PO_4$) + water ($H_2O$) + carbon dioxide ($CO_2$).

Mixing of sodium bicarbonate ($2NaHCO_3$) + phosphoric acid ($H_3PO_4$) results in the production of disodium phosphate ($Na_2HPO_4$) + water ($2H_2O$) + carbon dioxide ($2CO_2$).

Mixing of ammonium bicarbonate ($NH_4HCO_3$) + phosphoric acid ($H_3PO_4$) results in the production of monoammonium phosphate ($NH_4H_2PO_4$) + water ($H_2O$) + carbon dioxide ($CO_2$).

Mixing of ammonium bicarbonate ($2NH_4HCO_3$) + phosphoric acid ($H_3PO_4$) results in the production of diammonium phosphate ($[NH_4]_2HPO_4$) + water ($2H_2O$) + carbon dioxide ($2CO_2$).

Mixing of potassium bicarbonate ($KHCO_3$) + phosphoric acid ($H_3PO_4$) results in the production of monopotassiumphosphate ($KH_2PO_4$) + water ($H_2O$) + carbon dioxide ($CO_2$).

Mixing of potassium bicarbonate ($2KHCO_3$) + phosphoric acid ($H_3PO_4$) results in the production of dipotassium phosphate ($K_2HPO_4$) + water ($2H_2O$) + carbon dioxide ($2CO_2$).

The apparatus can be provided with one or more rollers, brushes or the like, which apply the developed foam to the surface to be cleaned, for instance a carpet, rug or the like. Advantageously, the apparatus will be provided with at least two separate chambers in which the respective components are separately accommodated and which are in communication with one another by means of one or more conduits which can be closed by sliding valves or similar members.

To make it possible to bring the two components into contact with each other without requiring any special equipment for this purpose, it is advantageous if the chamber accommodating the component that is dissolved in water is located at a higher level than the chamber accommodating the other component. In this case, the two components can be admixed by gravity action. Advantageously, in order to fill the upper chamber with water and to facilitate the dissolution of the component therein, the upper part of the upper chamber should be provided with a sieve. Also, the upper chamber which is to accommodate the component that is dissolved in water will advantageously be wholly, or at least in part transparent, for instance of a synthetic plastic material, so that the filling level can be readily determined, as well as the proper dissolution of the one component in the water.

The other chamber will then accommodate the acid and, in order to prevent the acid from spilling in case of rapid movement of the apparatus, it is advantageous to provide this other chamber with partition walls which may be advantageously horizontally or vertically oriented and which are provided with openings. This other chamber is advantageously provided in its upper region at the side facing towards the roller or brush which applies the foam to the surface to be cleaned, with slot-shaped outlet openings extending over the width of the container so that foam which develops can escape from the interior of the second or lower chamber. It is also advantageous to provide in the upper region of this second or lower chamber a foam collecting channel, and to make the cross section of this second chamber triangular and to so arrange the second chamber that in operation of the apparatus, the foam collecting channel will have a substantially horizontal orientation.

The apparatus according to the present invention can also be so constructed that the chamber accommodating the component that is dissolved in water will be configurated as an elastically deformable container, for instance as a squeeze bottle of soft synthetic plastic material. The other container which accommodates the acid may be in form of a hollow cap-shaped member which is mounted on the squeeze bottle or the like, and the latter may be provided with an interior riser tube or the like, communicating with an upper outlet through which the aqueous solution can be squeezed out and into the hollow cap-shaped member which accommodates the acid. The cap-shaped member will have one or more outlet openings through which the developing foam can escape, and these outlet openings may have a foam-permeable member extend across them so that foam can pass through this member and the outlet opening, but acid alone cannot.

By resorting to the present invention, foam in the requisite amounts can be readily and inexpensively produced in an apparatus which is simple in its construction and use. The gas necessary for the production of foam is generated chemically in the apparatus according to the present invention, which requires that merely two chambers be present which accommodate separate components. The production of the foam can be readily and simply controlled, and a great volume of foam with high cleaning efficiency can be obtained. It is particularly advantageous if the wetting agents which are admixed with one or both of the components are of the type which —when they dry again subsequently—will dry in powder or granular form. This has the advantage that the wetting agent with the absorbed dirt can be readily brushed off the surface being cleaned, or vacuumed off this surface. It is advantageous if the individual components are packaged in quantities which are stochiometrically accommodated to one another, and then can be readily filled into the respective chambers, so that a simultaneous using-up of components is assured without the components leaving any residues behind.

The spontaneous production of foam according to the present invention has the additional advantage that it is possible to influence the cleaning effect by appropriately selecting the reacting components. The disodium phosphate ($NA_2HPO_4$) which is obtained in one of the reactions, and the monosodium phosphate ($NaH_2PO_4$) which develops are salts which not only substantially aid the cleaning process, but because of the slightly acid pH value of the monosodium phosphate tend to freshen the colors of a textile material being cleaned. Also, the granularity of the dry cleaning substance residue, which is particularly advantageous in the case of rug and carpet cleaning, is furnished by the phosphate.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
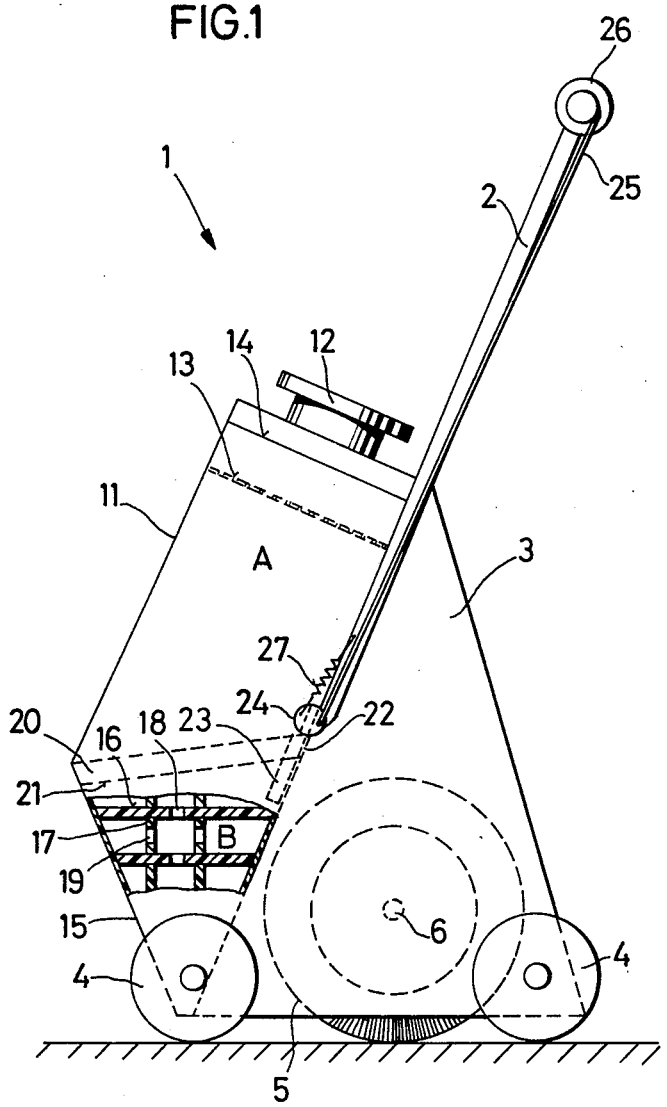
FIG. 1 is a partly sectioned, partly broken-away side view illustrating one embodiment of the invention.
Figure 2:
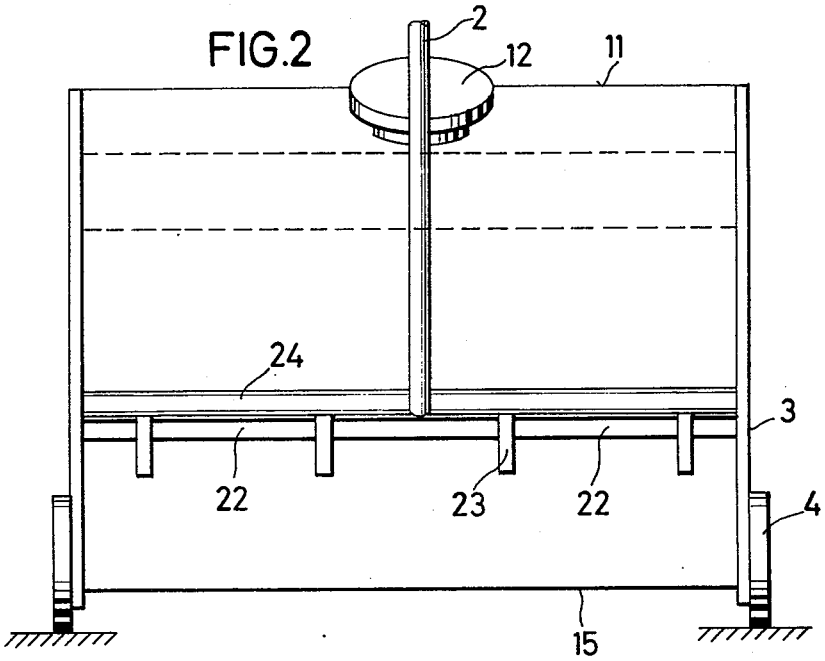
FIG. 2 is a fragmentary front view of the device shown in FIG. 1.

Referring firstly to the embodiments illustrated in FIGS. 1 and 2, it will be seen that the apparatus in toto is identified with reference numeral 1. In this embodiment, the apparatus has a frame 2 which can be wheeled about on rollers or wheels 4 so that it can be readily moved over a surface to be cleaned, such as a carpet, rug or the like. The apparatus has side walls 3 in which a brush roller 5 is mounted for rotation by means of shaft or shafts 6. The roller 5 is so positioned that its bristles will engage the surface over which the apparatus 1 rolls, so that the roller 5 is thereby driven and distributes foam over the surface to be cleaned.

The apparatus is provided with two compartments or containers 11 and 15 which are adapted to contain components A and B of the type discussed earlier. These components will chemically react with one another, when they come in contact, in such a manner that gas is liberated and foam is spontaneously generated. The components A and B are separately maintained in the containers 11 and 15, and conduits 23 are provided which connect these containers and which can be closed off by means of a rotary closure 24 or similar arrangements. The rotary closure 24 has several apertures which are distributed over the width of the apparatus and can be operated by a turnable handle 26 provided on the frame 2, and a rope or similar linkage 25 which is connected with the handle 26. The rotary closure 24 is urged by springs 27 to closed position and can be moved to open position against the force of the springs 27. When the rotary closure 24 is operated to open the conduits 23, aqueous solution of the component A can flow from the container 11 into the container 15. This results in the spontaneous generation of foam in the container 15, and the foam escapes via the slot-shaped outlet openings 22 onto the brush roller 5 which distributes it over the surface being cleaned. The component A may for instance be composed of 60 grams of $NaHCO_3$ (i.e., sodium bicarbonate), 90 grams $NH_4$—$HCO_3$ (ammonium bicarbonate), 180 grams $KHCO_3$ (potassium bicarbonate) and 30 grams of disodium laurate ethanolamidosulfosuccinate in powder form, for a total 360 grams. This amount of material can be admitted into the container 11 and a liter of water can be added to it, so that the material will become dissolved in the water. The contents of the container 15 may be 440 grams $H_3PO_4$ (phosphoric acid, approximately 70 percent) and 40 grams of sodium lauryl sulfate (approximately 28 percent).

Of course, this is only one example and a great number of other possibilities exists and will offer itself to those skilled in the art. This particular example, however, has been found to produce a very great amount of foam, and to produce a dust-like dry residue on the surface being cleaned, after the foam has dried, which residue can be readily removed by brushing or, better, by vacuuming.

In order to make the apparatus 1 ready for use, the closure 12 of the container 11 is opened and the component A is admitted into the container together with or separately from the water in which it is to be dissolved. If the component A is separately admitted, then it will initially drop onto a sieve 13 which is provided in the upper portion of the container 11. Thereupon, water is added until it reaches the level 14. Since the container 11 is advantageously of transparent material, such as transparent synthetic plastic material, a control of the liquid level is very readily possible by inspection from the exterior. The apparatus 1 is maintained during this filling operation in such a position that the level 14 which is marked will be horizontal. Since the water is poured through the powder which is resting on the sieve or screen 13, it will dissolve the powder as it runs through the same and through the screen 13.

Now, the closure 12 of the container 11 is used to close the latter, and the container 11 is shifted separately, or else the entire apparatus 1 is shifted in such a manner that the opening 22 becomes accessible for admission of the component B in form of a liquid acid (which may be admixed with one or more wetting agents) through the opening 22. The container 15 is of triangular cross section and the acid flows into it and is retained therein after the apparatus 1 is moved back to the position shown in FIG. 1.

If, now, the rotary closure 24 are opened, then liquid flows from the container 11 into the container 15, wherein an immediate vigorous development of foam begins as the two components A and B contact one another. The foam collects in the foam-collecting channel 20 formed in a partition wall 21, and then flows out of the openings 22 onto the roller 5 which distributes it onto the surface to be cleaned when the apparatus 1 is moved over this surface.

In order to prevent swapping-over of liquid from the container 15 to the exterior during the to-and-fro movements of the apparatus 1, the container 15 is provided with horizontally and/or vertically oriented partition walls 16, 17 which are provided with apertures 18 and 19, so that the foam can enter into the channel 20.

The amount of liquid which enters into the container 15 from the container 11 can be readily controlled by operation of the rotary closure 24, which means that the amount of foam being produced can be similarly easily controlled according to the particular requirements. When the rotary closure 24 is closed, the development of foam stops. Foam begins to develop again only after the rotary closure 24 is opened fully or partially.

Figure 3:
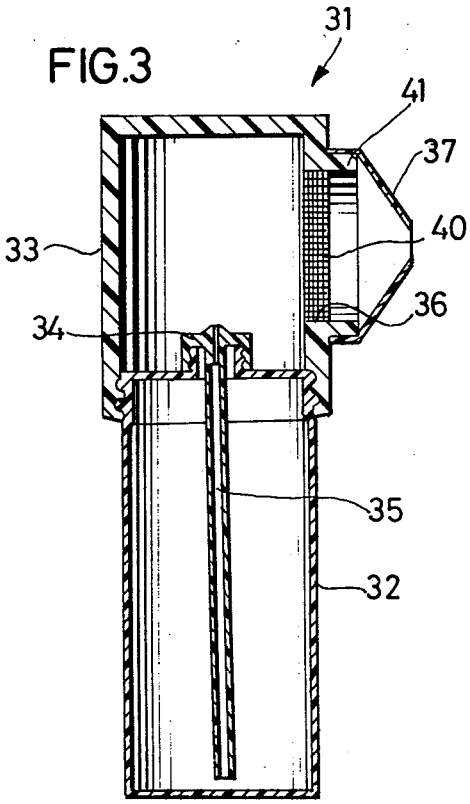
FIG. 3 is a vertical section through a further embodiment of the invention.
Figure 4:
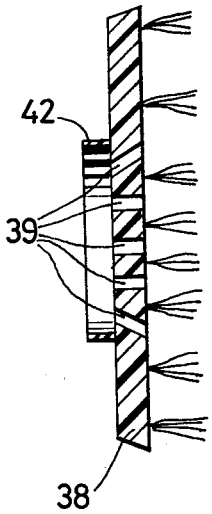
FIG. 4 is a fragmentary enlarged detail view illustrating an element that can be used with the embodiment in FIG. 3.

The apparatus shown in FIGS. 3 and 4 is of a different embodiment of the invention, showing a device which may for instance be hand held but which can also be mounted on a suitable support, for instance a support provided with the wheels shown in FIGS. 1 and 2.

In any case, in the apparatus of FIGS. 3 and 4 I have illustrated a squeeze bottle 32 of soft synthetic plastic material, which accommodates the component A. A riser tube 35 is mounted in the bottle 32 and provided with a spray head 34. A hollow cap 33 is screwed onto the upper end of the bottle 32 and accommodates the component B.

It is evident that when the bottle 32 is squeezed together, liquid (the component A) is forced to rise through the tube 35 and enter into the interior of the cap 33, wherein as a result of contacting between the components A and B an immediate development of foam will begin. An outlet opening 36 is formed in the cap 33, through which the foam can leave to the exterior. A foam-permeable wall 40 may extend across the outlet opening 36 and permit the foam to penetrate through to the outside. Said wall 40 includes fine openings passing the foam.

If it is desired to produce a well-defined stream of foam, for instance for washing of automobiles, the outlet opening 41 may also be provided with a nozzle 37. In place of the nozzle 37, a brush unit 38 may be affixed to the cap 33; in this case, the foam will exit through the channels 39. This is shown in FIG. 4, wherein it will be seen that this component can be removably placed onto the outlet opening 41 of cap 33, using the shown tubular inlet 42 of the brush unit 38. Said inlet tube 42 is slid over socket of the outlet opening 41.

It will be understood that each of the elements described above, or two or more together, may also find a useful application in other types of constructions differing from the type described above.

While the invention has been illustrated and described as embodied in an apparatus for producing foam for the cleaning of textiles, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applivations without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. An apparatus for producing foam for cleaning of textiles, especially of rugs and carpets, comprising applying means for applying foam to a surface to be cleaned; wall means defining two chambers each of which is adapted to accommodate one of two chemical components which react upon contact with one another and spontaneously produce foam for cleaning purposes; first and second passage means connecting said chambers with one another and with said applying means; and control means for selectively varying the effective cross-section of said first passage means so as to permit contacting of controlled amounts of one of said components with the other component via said first passage means, to result in spontaneous production of foam which is supplied to said applying means.

2. An apparatus as defined in claim 1, wherein one of said chambers is adapted to accommodate one of said chemical components in form of an aqueous solution; and wherein said one chamber is located upwardly of the other of said chambers to permit gravity flow of said solution from said one chamber into said other chamber.

3. An apparatus as defined in claim 2, said one chamber having an upper inlet end for water; and further comprising a sieve in said one chamber in the region of said upper inlet end.

4. An apparatus as defined in claim 1, wherein one of said chambers is provided with a plurality of apertured partition walls.

5. An apparatus as defined in claim 4, wherein said partition walls have a substantially vertical orientation.

6. An apparatus as defined in claim 4, wherein said partition walls have a substantially horizontal orientation.

7. An apparatus as defined in claim 1, one of said chambers having an upper region spaced from said applying means and formed with a plurality of slot-shaped openings for exiting of the spontaneously produced foam from said one chamber.

8. An apparatus as defined in claim 1, one of said chambers having an upper region provided with a partition wall which forms a foam collecting channel.

9. An apparatus as defined in claim 8, wherein said one chamber is of substantially triangular cross section, and wherein said foam collecting channel is substantially horizontally oriented when said apparatus is in operating position.

10. An apparatus as defined in claim 1, wherein one of said chambers is formed by an elastically deformable container having an upper outlet, and wherein the other of said chambers is formed by a hollow cap member mounted on said container and having a foam-dispensing outlet and an interior which accommodates one of said components and communicates with said outlet; and further comprising a riser tube in said container and communicating with said outlet so that contents of said container exit through said outlet and into said interior of said cap member in response to elastic deformation of said container.

11. An apparatus as defined in claim 10, wherein said container is a plastic squeeze bottle.

12. An apparatus as defined in claim 10; and further comprising a foam-permeable wall extending across said foam-dispensing outlet.

* * * * *